US010845112B2

(12) United States Patent
Placke et al.

(10) Patent No.: US 10,845,112 B2
(45) Date of Patent: Nov. 24, 2020

(54) CONTAINER ARRANGEMENT AND REFRIGERATION DEVICE WITH A CONTAINER ARRANGEMENT

(71) Applicants: Miele & Cie. KG, Gütersloh (DE); BSH Hausgeräte GmbH, Munich (DE)

(72) Inventors: Frank Placke, Gütersloh (DE); Daniel Baßler, Aalen (DE); Herbert Cizik, Ottenbach (DE); Jessica Dittman, Herbrechtingen (DE)

(73) Assignees: Miele & Cie. KG, Gütersloh (DE); BSH Hausgeräte GmbH, Munich (DE)

( * ) Notice: Subject to any disclaimer, the term of this patent is extended or adjusted under 35 U.S.C. 154(b) by 140 days.

(21) Appl. No.: 16/248,919

(22) Filed: Jan. 16, 2019

(65) Prior Publication Data

US 2019/0234669 A1 Aug. 1, 2019

(30) Foreign Application Priority Data

Jan. 30, 2018 (DE) ..... 10 2018 101 997

(51) Int. Cl.

| | |
|---|---|
| ***F25C 5/182*** | (2018.01) |
| ***F25C 5/20*** | (2018.01) |
| ***B65D 1/38*** | (2006.01) |
| ***B65D 21/02*** | (2006.01) |
| ***B65D 25/04*** | (2006.01) |

(52) U.S. Cl.

CPC ..... *F25C 5/182* (2013.01); *B65D 1/38* (2013.01); *B65D 21/0233* (2013.01); *B65D 25/04* (2013.01); *F25C 5/22* (2018.01); *F25C 5/24* (2018.01)

(58) Field of Classification Search

CPC .... F25C 5/182; F25C 5/22; F25C 5/24; F25C 2400/10; B65D 1/38; B65D 21/0233; B65D 25/04; F25D 25/005

See application file for complete search history.

(56) References Cited

U.S. PATENT DOCUMENTS

| | | | | |
|---|---|---|---|---|
| 3,427,682 | A | 2/1969 | Bachmann | |
| 2003/0172664 | A1* | 9/2003 | Collins | F25C 5/187 62/137 |
| 2011/0314860 | A1* | 12/2011 | Tafoya | F25C 5/182 62/344 |

FOREIGN PATENT DOCUMENTS

| | | | | |
|---|---|---|---|---|
| CN | 202092406 | U | 12/2011 | |
| DE | 102014212115 | A1 | 12/2015 | |
| EP | 3037763 | A1 * | 6/2016 | F25D 25/025 |
| EP | 3037763 | A1 | 6/2016 | |
| JP | 2002130933 | A | 5/2002 | |
| JP | 2007120906 | A | 5/2007 | |

(Continued)

*Primary Examiner* — Emmanuel E Duke

(74) *Attorney, Agent, or Firm* — Dickinson Wright PLLC

(57) ABSTRACT

A container arrangement for use in an interior (2) of a refrigeration device (1) includes a box-shaped container (40) with a bottom part (41) surrounded or enclosed by peripheral side walls (42) and with a loading opening (46) with an opening edge (43) defining a free end of the side walls (42), and an insert tray (50) for positioning in the container (40). The opening edge (43) includes a receiving shape (45) which interacts with a corresponding positioning device (55) on the tray (50) to define a predetermined inserted position of the insert tray (50) relative to the opening (46). The container arrangement (4) is configured for being pushed into and pulled out of the interior (2).

20 Claims, 6 Drawing Sheets

(56) References Cited

FOREIGN PATENT DOCUMENTS

| | | | | | |
|---|---|---|---|---|---|
| WO | 2006125630 | A1 | | 11/2006 | |
| WO | 2008095753 | A2 | | 8/2008 | |
| WO | 2008135473 | A2 | | 11/2008 | |
| WO | WO-2009037126 | A1 | * | 3/2009 | ..... B65D 25/06 |
| WO | 2012106316 | A2 | | 8/2012 | |
| WO | WO-2012106316 | A2 | * | 8/2012 | ..... F25D 25/025 |
| WO | 2017152955 | A1 | | 9/2017 | |
| WO | WO-2017152955 | A1 | * | 9/2017 | ..... F25D 25/025 |

* cited by examiner

CONTAINER ARRANGEMENT AND REFRIGERATION DEVICE WITH A CONTAINER ARRANGEMENT

TECHNICAL FIELD

The invention relates to a container arrangement for use in the interior of a refrigeration device, such as a freezer, comprising a box-shaped container with a bottom part, which is surrounded or enclosed by peripheral side walls, and a loading opening with an opening edge defining the free end of the side walls, wherein the container arrangement is configured for being pushed into and pulled out of the interior.

BACKGROUND

From WO 2008/095753 A2, a container arrangement is known In the form of a telescopic pull-out, which includes a box-shaped container for receiving refrigerated goods. There is no provision herein for organizing the refrigerated goods placed inside in any way.

From WO2008135473 A2, a freezer with shelves and pull-outs is known, which has a unit for producing ice cubes. A collection container, which can be pulled out of the freezer, is located beneath this unit. The collection container is hence designed as a separate pull-out.

SUMMARY

It is thus the object of the invention to improve the overall view and the accessibility of refrigerated goods in a container.

This object is achieved by an additional receptacle for frozen goods, such as ice cubes, provided in a simple manner, which allows tidy organization in the container. It is thereby easily ensured that the additional receptacle is inserted in its intended place. This is provided by an insert tray for use in the container, wherein the opening edge of the superordinate container comprises receiving shape which interacts with a corresponding positioning device on the inserted tray to fix the tray in a predetermined position relative to the plane of the opening.

In a practical embodiment, the positioning device of the insert tray is an outer bar extending from the opening edge, which extends over nearly the entire width of the insert tray and is designed to engage with the receiving shape on the container side. The bar forms thus a collar or flange on the back side of the tray, which comes to rest upon the receiving shape on the container.

In an overall advantageous embodiment, the opening edge of the container comprises a peripheral frame, wherein the receiving shape is arranged on a frame part of a single side wall, preferably the back wall. The receiving shape is furthermore configured as a part of the opening edge. A simple and solid support device without delicate and damage-prone projections is created in this way.

In a preferred further development, the receiving shape is located on the rear side wall of the container, preferably on or in the frame part of the rear side wall, with regard to its predetermined inserted position in the interior of the refrigeration device.

In an overall advantageous embodiment, the positioning device and receiving shape are configured for entering into a form-locking connection with one another. The predetermined position of the insert tray is thus always ensured, while slippage due to movement of the container is reliably suppressed or prevented.

In an advantageous further development, the receiving shape is formed by a recess in the frame in the direction of the container bottom, or by a U-shaped arch in the frame part with the vertex pointing in the direction of the bottom.

In an alternative embodiment, the receiving shape is formed by an interruption or a gap in the frame. This is particularly easy to realize because the frame part does not need to be reshaped during the manufacturing process. The underlying container wall can furthermore have a straight, continuous edge, which is easier to produce.

In a preferred embodiment, the insert tray comprises projections attached to the floor on the outside. These provide a good stand when the bottom of the tray is not entirely level.

In an overall advantageous embodiment, the box-shaped container is a basket made of metal wire or plastic mesh with a frame attached at the opening edge. This is particularly appropriate for use in a freezer, because a good distribution of the cold air within the interior is hardly impaired by the inserted baskets.

In a preferred further development, the projections are affixed or positioned in such a way that they engage in a mesh in the bottom of the basket when positioned correctly. An additional fixation against lateral slipping is made available thereby. The projections are preferably mounted on the bottom on the side away from the positioning device to make available a fixation of the tray on the front side.

In an overall advantageous embodiment, the box-shaped container comprises a bottom-side positioning device, which positions the insert tray inserted into the container on the bottom side on two opposite sides. A more reliable and secure support for the insert tray is made available thereby within the box-shaped container.

In a practical further development, the positioning device comprises two mutually spaced longitudinal rails, against which the lower area of the side walls of the insert tray abuts. It is thereby ensured that the insert tray cannot slip to either side. Overall it is achieved that the insert tray cannot be moved out of its predetermined position when the container is moved. Especially sideways slippage is avoided or prevented with this rail arrangement. Furthermore, the optical and tactile perception of the rails provides guidance to the user when he or she wishes to insert the tray into its predetermined position.

In another advantageous further development, the lower area of the insert tray ( ) has a curved shape in the area where the two side walls transition to the bottom, wherein the rails have a correspondingly curved profile to receive the curve of the insert tray (50) in the lower area. The insertion of the tray into the positioning device is thereby made easier, because the insert tray independently centers itself between the two positioning rails.

In an overall practical embodiment, the rails are releasably fixed on the container bottom, wherein the rails each exhibit hooks and/or locking structures with which they are affixed to the bottom of the box-shaped container, wherein the hooks and/or locking structures preferably interact with the metal wire of the basket mesh. Due to the releasable configuration, the same rails can be used for differently wide insert trays as the parallel separation of the rails can be varied.

In another overall advantageous embodiment, the insert tray is configured in such a way that it extends from the front wall of the container to the back wall when in its inserted state. The interior of the container is thus optimally utilized, so that the insert tray can have a large volume.

Furthermore, it is overall advantageous that the box-shaped container is dimensioned in such a way that a free space is made available within the container on the sides of the tray. This means that, when viewed from the loading direction, items can be placed for storage on the left and right of the insert tray.

In an overall practical embodiment, the insert tray is water-tight and is designed to be open only on the top and intended to be used to receive ice cubes.

The invention furthermore relates to a freezer with an interior and a container arrangement arranged therein as previously described, which has telescopic pull-outs that can be telescopically guided within the interior.

In a practical further development, the freezer comprises an ice maker located within it or in its interior, which is configured for automatically producing ice cubes from water, wherein the ice maker has a dispensing opening for dispensing prepared ice cubes, wherein the container arrangement can be placed beneath the dispensing opening and the insert tray can be positioned in such a way that the ice cubes fall into it due to gravity.

BRIEF DESCRIPTION OF THE DRAWINGS

Examples of the invention are depicted schematically in the drawings and will be described in greater detail in the following, wherein.

DETAILED DESCRIPTION OF THE DRAWINGS

Figure 1:
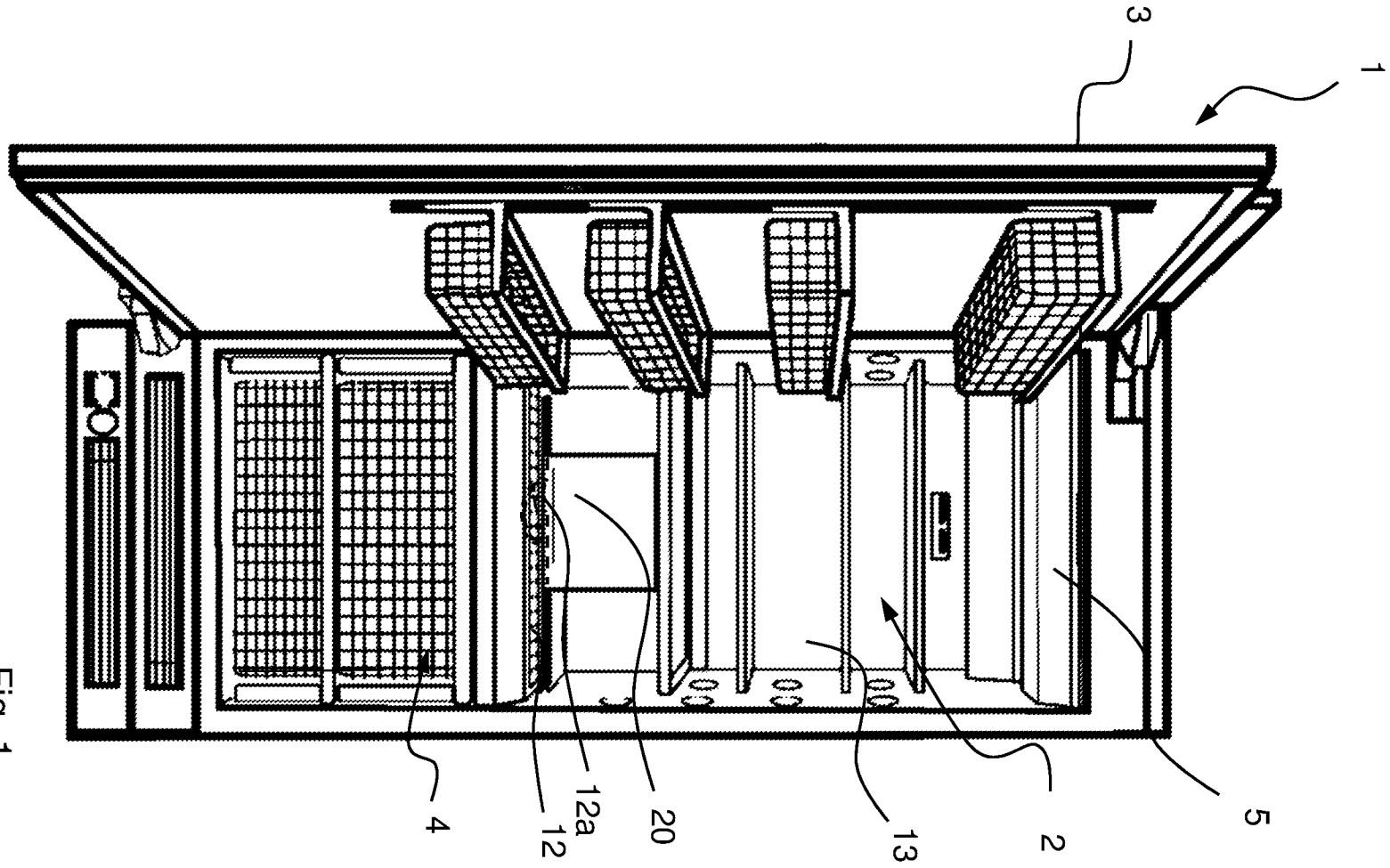
FIG. 1 shows a frontal view of a freezer with view into the interior.

FIG. 1 shows as an example a refrigeration device configured as a freezer 1 with an interior 2 and a door 3 for sealing the interior 2. The freezer has a cooling unit 5 which cools the interior 2. In the interior are shelves 12, 13 and a container arrangement 4 for storing frozen goods. The depicted freezer is also equipped with an ice maker 20, which produces ice cubes from liquid water. These drop through an outlet through a gap 12*a* in the container bottom 12 and are caught and collected in the collection tray 50 (FIG. 2) located below. The collection tray (50) is therefore a component of the container arrangement 4 arranged beneath the ice maker 20.

Figure 2:
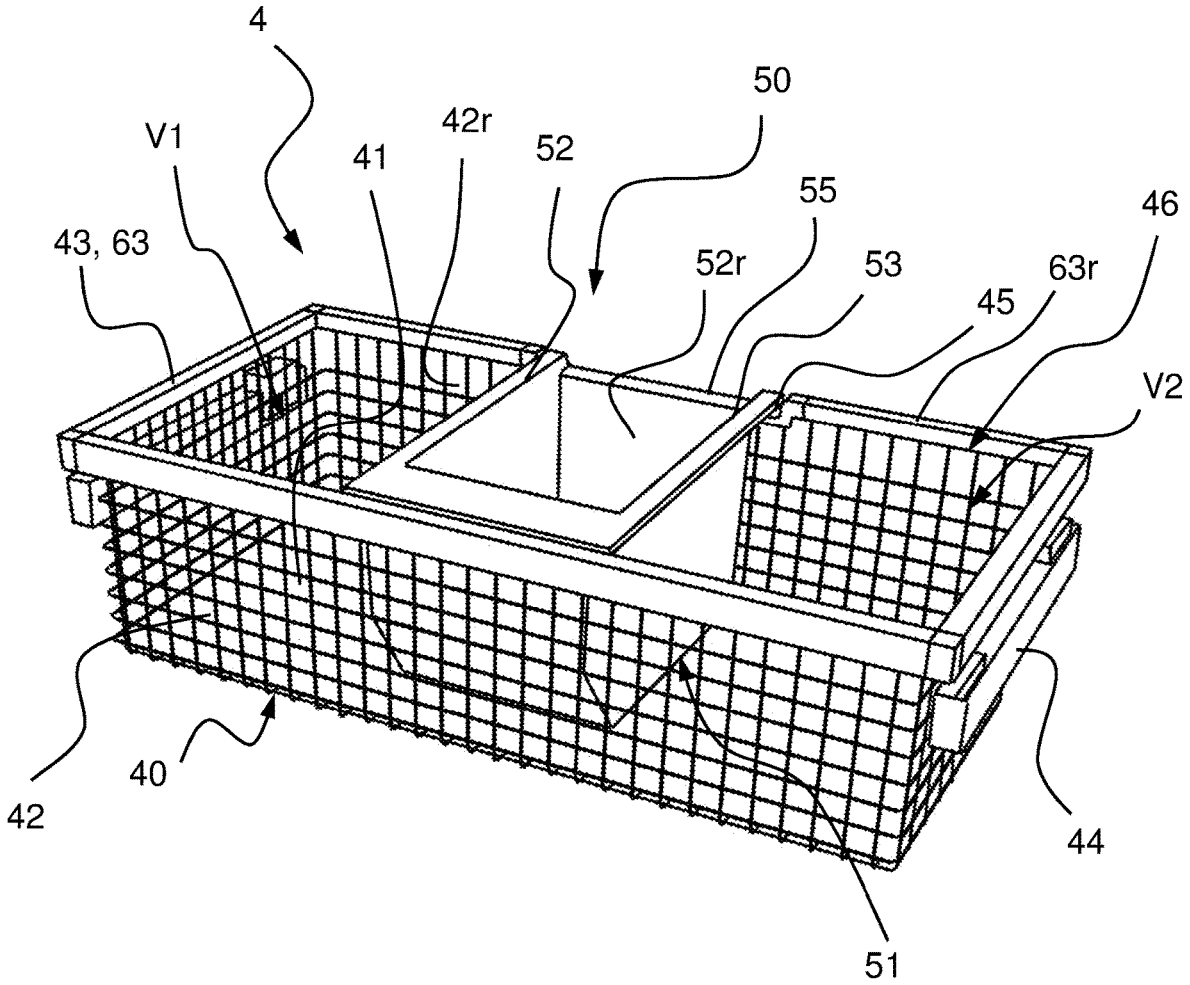
FIG. 2 shows a first embodiment of a container arrangement as an individual component.

FIG. 2 shows a preferred embodiment of the container arrangement 4. The latter comprises a box-shaped container 40, which is here of a basket made of wire mesh. The container 40 comprises a bottom 41 and the side walls 43 surrounding the bottom. The container 40 is furthermore equipped with pull-out handle 44, which is provided for the attachment of the arrangement 4 in the interior 2 (FIG. 1). The container is open on its upper side and offers access to the interior of the container 40 with this opening 46. The opening edge 43 is provided with a frame 63, which stabilizes the basket or the free ends of the peripheral side wall 42. The back wall 42*r* is provided with a frame part 63*r* which is formed into a recess 45 or has a downward U shape in its middle area. A tray 50, which in this example is not configured as a basket, but rather as a closed container 50 with a bottom 51 and a peripheral wall 52 and is open on the top and thus provides an opening, is placed into the container 40. An outwardly protruding bar 55 or flange, which engages with the recess in the situation shown, is affixed in the upper area on the rear side wall 52*r*. The upper edge 53 of the tray 50 is thereby dimensioned in such a way in an advantageous embodiment shown here that it does not protrude beyond the upper side of the peripheral frame 46 in its inserted state.

Figure 3:
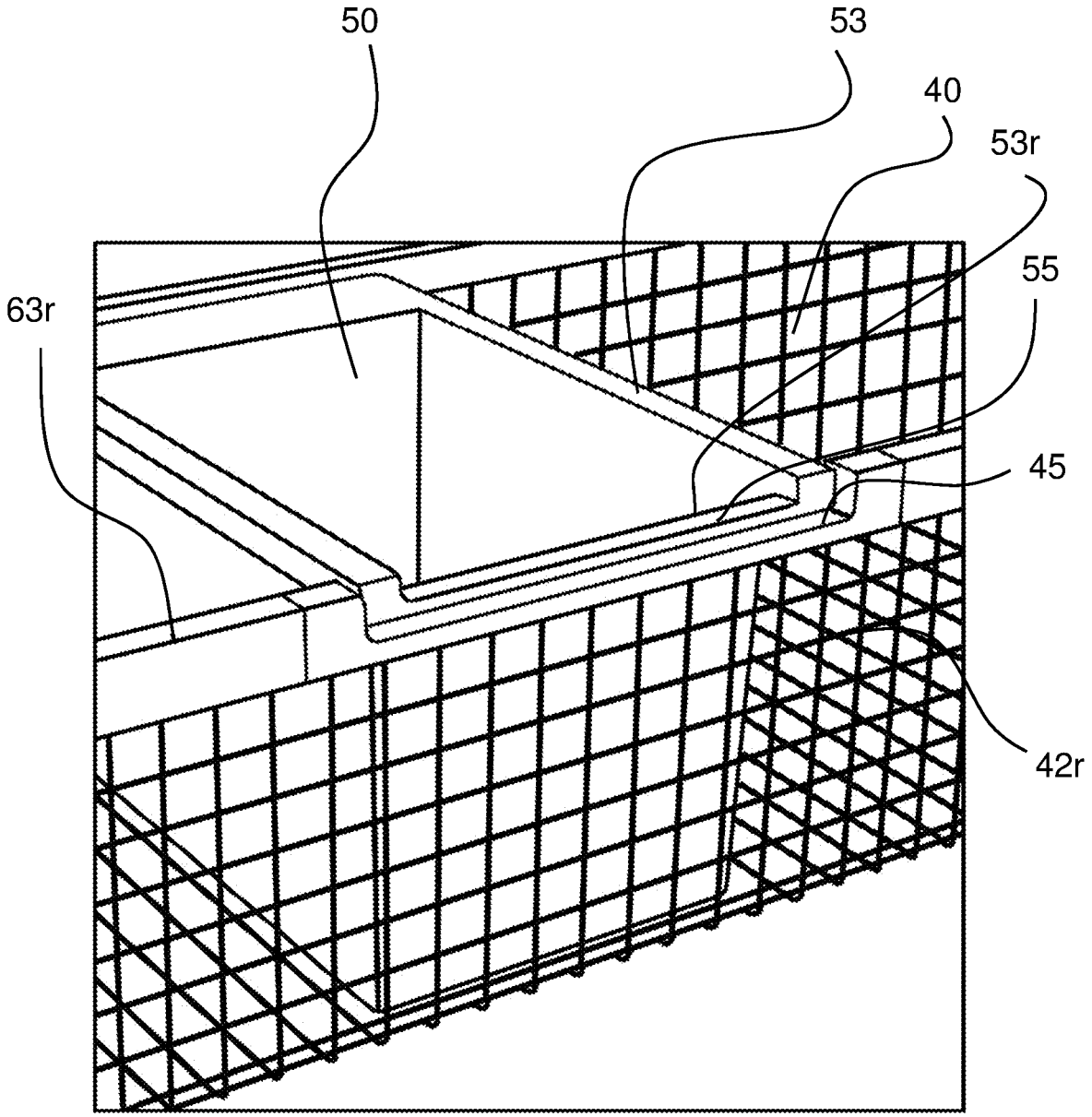
FIG. 3 shows a detail of the container arrangement of FIG. 2.

FIG. 3 shows a detailed view of the container 40 from the back side. Here can be seen the rear wall 42, which is woven from wire, at whose free end 43 the frame part 63*r* is fitted. The frame part 63*r* is provided in some areas with a recess 45, which serves as a receiving shape 45 for the corresponding positioning device 55 of the insert tray 50. A tongue or bar 55 is provided as a positioning device at the opening edge of the tray 50. This bar 55 or flange then rests in the trough 45 in its inserted state and is thereby fixed in its position.

Figure 4:
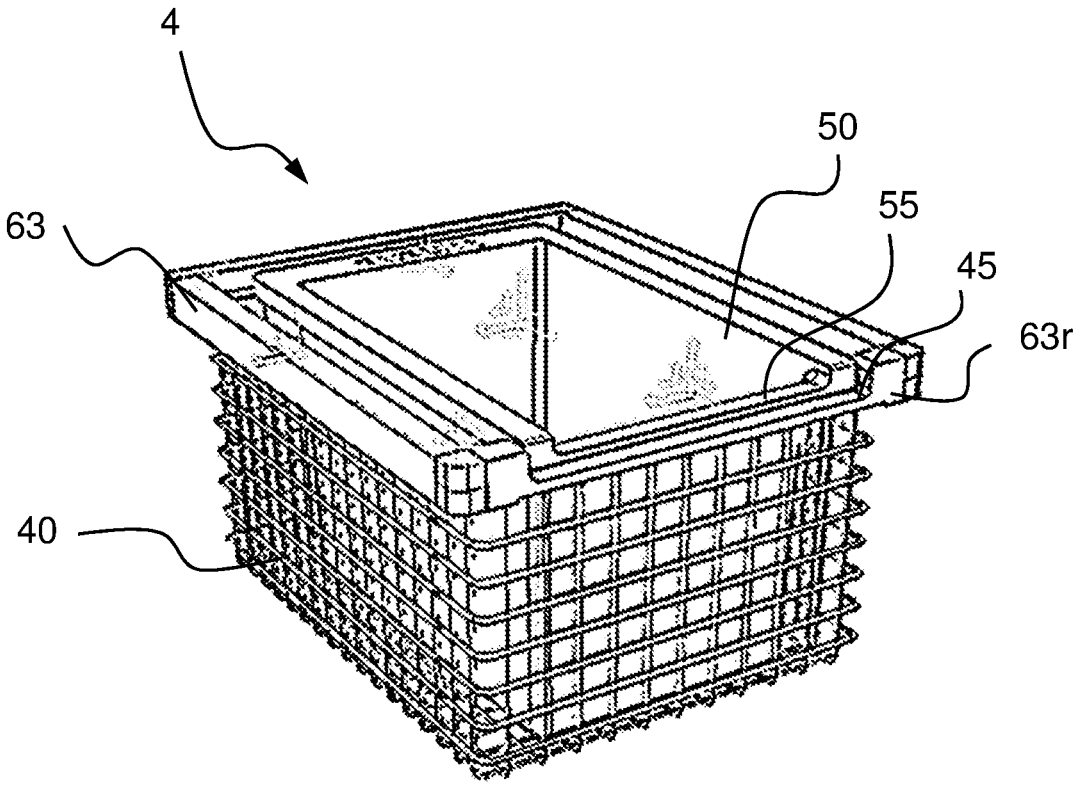
FIG. 4 shows another embodiment of a container arrangement as an individual component.

FIG. 4 shows the container arrangement 4 in an embodiment with a narrow container 40, which is almost completely filled out by the inserted tray 50. The free spaces V1, V2 on either side of the tray 50 are here markedly smaller than in the example according to FIGS. 2 and 3.

Figure 5:
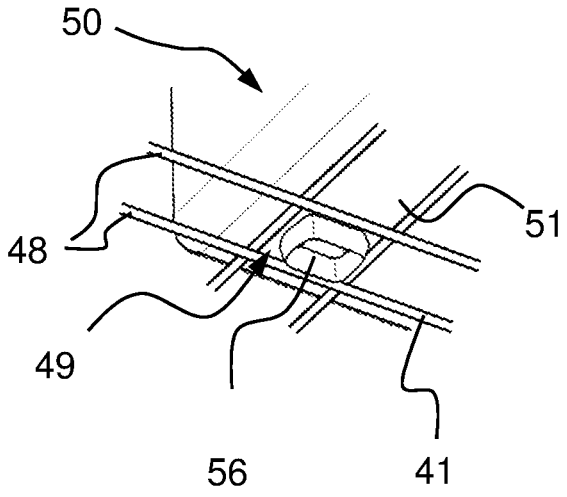
FIG. 5 shows a detail view of a preferred embodiment from underneath.

FIG. 5 shows a cutout of the tray 50 in a preferred configuration from the bottom side. A projection 56 is affixed, preferably molded, thereby on the outside on the bottom 51. The projection 56 serves as a foot when the tray is placed on a surface, for example, a tabletop. The projection 56 is positioned thereby in such a way that it engages in a mesh 49 in the container bottom 41 when the tray 50 is inserted in the container 40. The container 40 in the example shown is a basket made of intersecting or woven wires 48.

Figure 6:
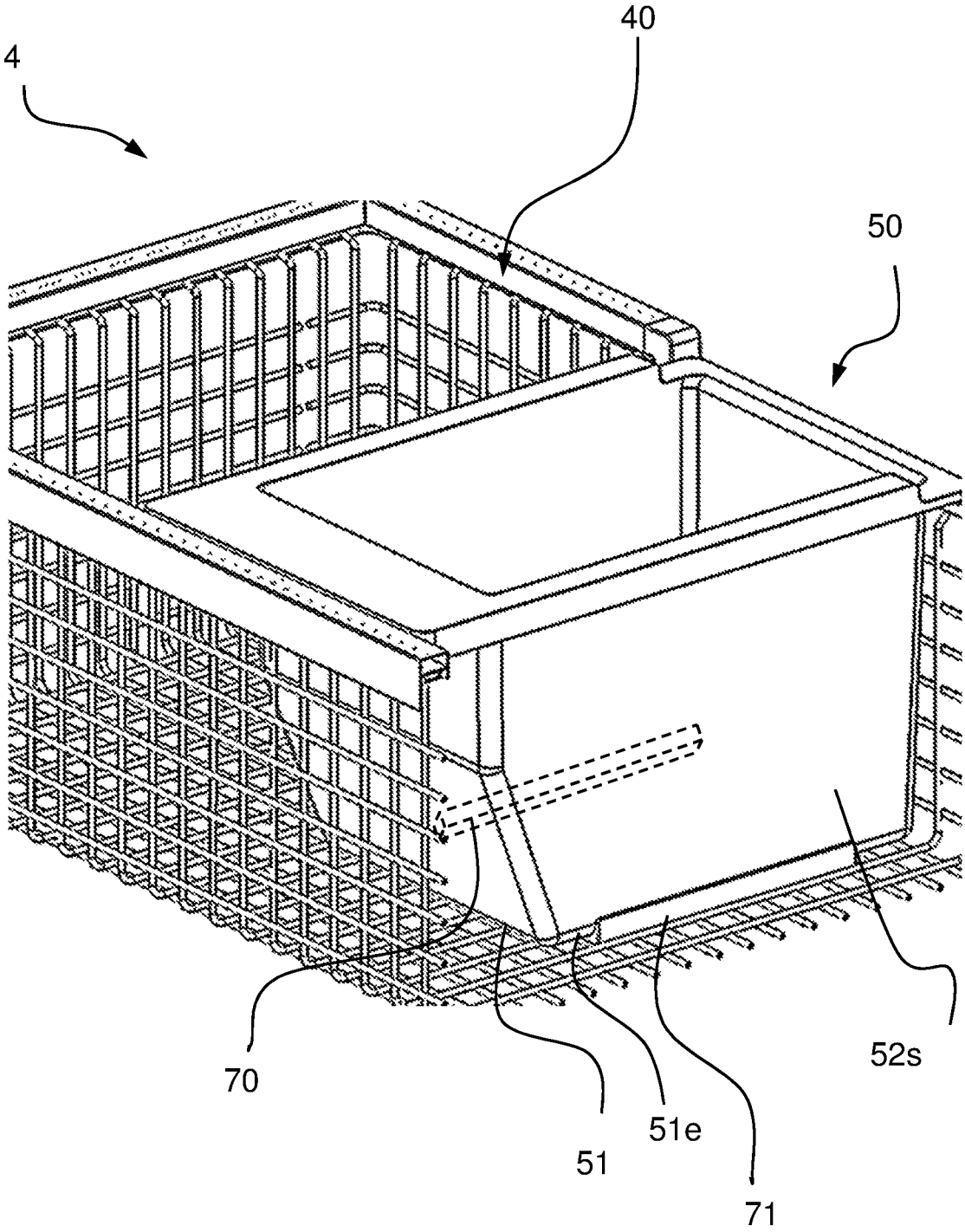
FIG. 6 shows a further embodiment with a bottom-side positioning device.

FIG. 6 shows an embodiment of the container arrangement 4 with bottom-side longitudinal rails 70, 71, which supports the tray 50 inserted in the container 40 with its two opposite side walls 52*s* or the bottom-side corners 51*e*. The corners 51*e* are preferably configured rounded with a radius within the range of 0.5 cm to 2 cm. The rails 70, 71 are provided with a corresponding concave profile 75 (FIG. 7) in their longitudinal extension.

Figure 7:
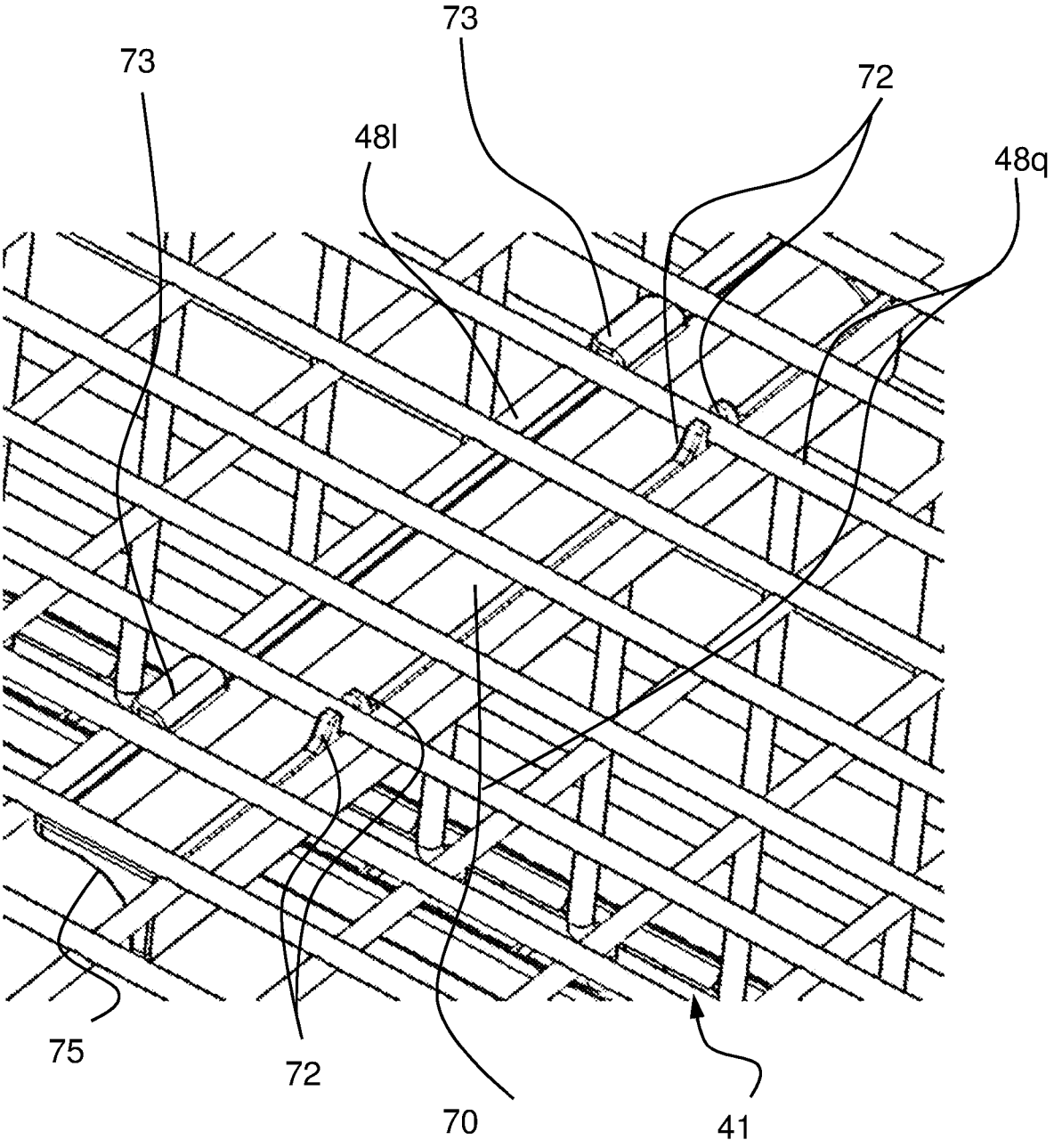
FIG. 7 shows a detail view of the embodiment of FIG. 6.

FIG. 7 shows the container 40 according to the embodiment shown in FIG. 6 from the underside. Here is shown on the example of a rail 70 how it is affixed on the bottom side to the wires 48*l* and 48*q*. The rail 70 is provided thereby with at least one hook 73 which grasps a wire 48*l*, in this case a longitudinal wire. A locking structure 72, which locks with a transversally running wire 48*q* of the container bottom 41, is affixed on an opposite side of the rail 70. To attach the rail 70, the latter is first threaded with the hook 73 under the wire 48*l*, then pivoted in order to reach two transversally running wires 481 with the locking structure 72 and lock it together with these.

All positional and directional references are related as a whole to the operational setting position or installation situation of the refrigeration device 1.

While the above description constitutes the preferred embodiments of the present invention, it will be appreciated that the invention is susceptible to modification, variation and change without departing from the proper scope and fair meaning of the accompanying claims. In particular, the described embodiments are not mutually exclusive, and the features of the various designs may be selectively combined in a single container arrangement.

The invention claimed is:

1. A container arrangement for use in an interior (2) of a refrigeration device (1), the container arrangement comprising:

a box-shaped container (40) with a bottom part (41) surrounded or enclosed by peripheral side walls (42) and with a loading opening (46) with an opening edge (43) defining a free end of the side walls (42), an insert tray (50) for positioning in the container (40), wherein the opening edge (43) includes a receiving shape (45) which interacts with a corresponding positioning device (55) on the tray (50) to define a predetermined inserted position of the insert tray (50) relative to the opening (46), wherein the container arrangement (4) is configured for being pushed into and pulled out of the interior (2), wherein the insert tray has an upper edge (53) dimensioned not to protrude above the opening edge (43) of the loading opening (46) of the box-shaped container (40).

2. The container arrangement according to claim 1, wherein the insert tray (50) comprises an outer bar (55) extending from the opening edge (53) as a positioning device, which extends along a width of the insert tray (50) and is configured for engaging with the receiving shape (45) on the container.

3. The container arrangement according to claim 1, wherein the opening edge (43) of the container comprises a peripheral frame (63), wherein the receiving shape (45) is arranged on the frame (63) on one side of the opening edge (43).

4. The container arrangement according to claim 3, wherein the receiving shape (45) is formed by a recess in the frame (63*r*) toward the bottom part or by a U-shaped arch (45) in the frame (63*r*) with a vertex pointing toward the bottom part (41).

5. The container arrangement according to claim 3, wherein the receiving shape (45) is formed by an interruption or a gap in the frame (63*r*).

6. The container arrangement according to claim 1, wherein the receiving shape (45) is located at a rear side wall (42*r*) of the container (40) with regard to a predetermined installed position of the container arrangement in the interior (2) of the refrigeration device (1).

7. The container arrangement according to claim 1, wherein the positioning device (55) and receiving shape (45) are configured for entering into a form-locking connection with one another.

8. The container arrangement according to claim 1, wherein the insert tray (50) has a floor (51) with an outside, to which projections (56) are attached.

9. The container arrangement according to claim 8, wherein the box-shaped container (40) is a basket and wherein the projections (56) are affixed or positioned in such a way that they engage in a mesh (49) in the bottom part (41) of the basket (40) when positioned correctly.

10. The container arrangement according to claim 1, wherein the box-shaped container (40) is a basket made of metal wire (48) or plastic mesh with a frame (63) forming the opening edge (43).

11. The container arrangement according to claim 1, wherein positioning device of the box-shaped container (40) comprises a bottom-side positioning device (70, 71), which positions the insert tray (50) inserted into the container (40) at two opposite sides.

12. The container arrangement according to claim 11, wherein the positioning device further comprises two mutually spaced longitudinal rails (70, 71), against which side walls (52*s*) of the insert tray (50) abut in a lower area or corner area (51*e*).

13. The container arrangement according to claim 12, wherein the lower area of the insert tray (50) has a bottom (51) and has a curved area (51*e*) where the side walls (52*s*) transition to the bottom (51), wherein the rails (70, 71) have a correspondingly curved profile (75) to accommodate the curved area (51*e*) of the insert tray (50) in the lower area.

14. The container arrangement according to claim 12, wherein the rails (70, 71) are each affixed to the bottom part (41) of the box-shaped container (40) by a locking structure (72).

15. The container arrangement according to claim 14, wherein the box-shaped container (40) is a basket made of metal wire (48) and wherein the locking structure (72) interacts with the metal wire (49) of the basket.

16. The container arrangement according to claim 1, wherein the insert tray (50) is configured in such a way that it extends from a front wall of the container to a back wall of the container when in the predetermined inserted position.

17. The container arrangement according to claim 1, wherein the box-shaped container (40) is dimensioned in such a way that a free space (V1, V2) is present on a lateral side of the insert tray within the container (40) when the tray is in the predetermined inserted position.

18. The container arrangement according to claim 1, wherein the insert tray (50) is suited to receive ice cubes.

19. A freezer with an interior (2) comprising a container arrangement telescopically guided within the interior (2) via pull-outs (44), the container arrangement including:

a box-shaped container (40) with a bottom part (41) surrounded or enclosed by peripheral side walls (42) and with a loading opening (46) with an opening edge (43) defining a free end of the side walls (42), an insert tray (50) for positioning in the container (40), wherein the opening edge (43) includes a receiving shape (45) which interacts with a corresponding positioning device (55) on the tray (50) to define a predetermined inserted position of the insert tray (50) relative to the opening (46), wherein the insert tray has an upper edge (53) dimensioned not to protrude above the opening edge (43) of the loading opening (46) of the box-shaped container (40).

20. The freezer according to claim 19; comprising an ice maker (20) arranged therein, which is configured for automatically producing ice cubes from water, wherein the ice maker (20) has a dispensing opening for dispensing prepared ice cubes, wherein the container arrangement (4) has a predetermined installed position beneath the dispensing opening, in which the insert tray (50) is positioned such that the ice cubes fall into the insert tray due to gravity.

* * * * *